United States Patent [19]

Rushforth

[11] 4,277,892

[45] Jul. 14, 1981

[54] GOLF TEE AWL AND AWL RETAINING SHEATH

[76] Inventor: Harold E. Rushforth, 1918 Monument Rd., NW., Canton, Ohio 44709

[21] Appl. No.: 115,398

[22] Filed: Jan. 25, 1980

[51] Int. Cl.[3] ..... B26F 1/00

[52] U.S. Cl. ..... 30/368; 224/232; 224/904; 273/32 B

[58] Field of Search ..... 273/32 R, 32 B, 32 D, 273/33; 30/368, 366; 224/232, 252, 269, 918, 904

[56] References Cited

U.S. PATENT DOCUMENTS

| | | | |
|---|---|---|---|
| 1,148,369 | 7/1915 | Farmer | 224/904 X |
| 4,090,298 | 5/1978 | Rushforth | 273/32 B X |
| 4,190,955 | 3/1980 | Rushforth | 30/368 X |

FOREIGN PATENT DOCUMENTS

| | | | |
|---|---|---|---|
| 17763 | 6/1908 | Norway | 224/232 |

*Primary Examiner*—George J. Marlo
*Attorney, Agent, or Firm*—Paul E. Milliken

[57] ABSTRACT

A golf tee awl for making holes in the ground to make it easier to insert golf tees. The awl has a circular knob-shaped handle with a sharpened shank or spike protruding therefrom and a protective sheath which covers the sharpened shank when the awl is not in use. The sheath has an elongated shank receiving member which is fixedly connected to a clip which fits on the belt of a person using the awl. The clip has an outwardly extending awl retaining portion which releasably engages the awl handle to retain the awl in the sheath, but may be deflected out of engagement with the handle to permit withdrawal of the awl from the sheath. The shank receiving member and handle are preferably made of plastic and the clip for the sheath is preferably made of metal.

6 Claims, 4 Drawing Figures

GOLF TEE AWL AND AWL RETAINING SHEATH

This invention relates to a golf tee awl for making holes in the ground prior to inserting golf tees and a sheath for holding the awl which can be worn on the belt of a person using the awl, which sheath is held on the belt by a clip which also serves to retain the awl in the sheath.

PRIOR ART

The closest prior art known to applicant is applicant's own prior U.S. Pat. No. 4,090,298 issued May 23, 1978.

OBJECTS OF THE INVENTION

It is a primary object of this invention to improve upon applicant's prior inventions in U.S. Pat. No. 4,090,298 and applicant's copending application Ser. No. 941,286 filed Sept. 11, 1978, now issued as U.S. Pat. No. 4,190,955 by providing a sheath which is easier to use when inserting and removing the awl from the sheath and by providing an improved clip having a retainer portion to prevent the awl from coming dislodged from the sheath when it is carried on the belt of a wearer.

Another object of the invention is to provide a sheath and awl combination which will be comfortable when worn by the user.

Another object of the invention is to provide a golf tee hole making device which can be carried on the user's belt without danger of injury from the spike member used to make the holes for the golf tees.

These and other objects of the invention will become more fully apparent as the description proceeds in the following specification and the attached drawings.

STATEMENT OF THE INVENTION

This invention is the combination of a golf tee awl for making holes in the ground for inserting golf tees and a sheath comprising: an awl having a handle, and a shank having one end connected to the handle and the opposite end being pointed for insertion in the ground, and a sheath comprising; an elongated clip for attachment to the belt of a person using the awl, an elongated awl receiving member fixedly attached to the clip in parallel alignment therewith, said awl receiving member having an axial receptacle therein for receiving the shank, and means on the clip releasably retaining the awl in the sheath.

DESCRIPTION OF THE PREFERRED EMBODIMENTS

Figure 1:
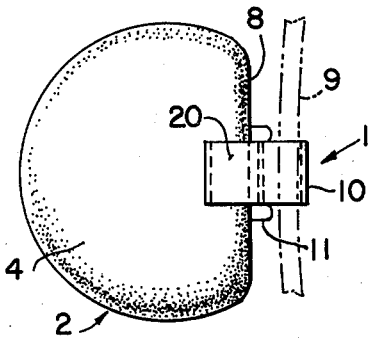
FIG. 1 is a top plan view of the device of the invention.
Figure 2:
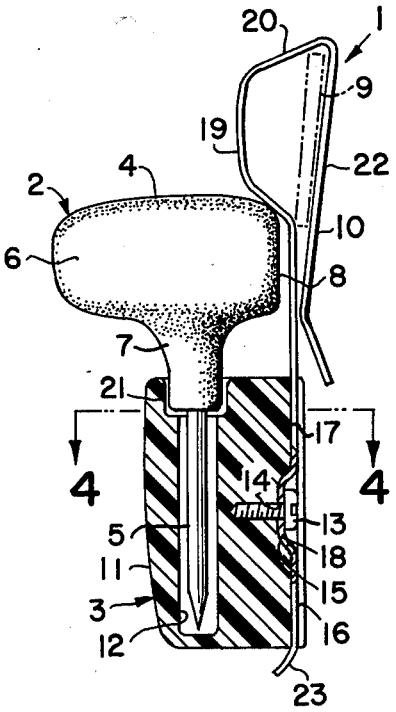
FIG. 2 is a side elevational view of the device of the invention with portions of the sheath broken away to show how the awl fits into the sheath.

Referring now to FIGS. 1 and 2 of the drawings, the entire awl and sheath assembly is indicated by the numeral 1. An awl 2 is removeably mounted in a sheath 3. The awl 2 has a handle 4 made preferably of plastic to which is attached an elongated shank or spike 5 having its free end sharpened to provide easier penetration into the ground. The handle 4 is shaped generally like one type of door knob and has a hand grippable portion 6 of substantially elliptical cross-section which merges with a shank receiving portion 7 which is frustoconical in cross-section. The grippable portion 6 has a truncated portion at one location on the circumference which forms a flat surface 8. The flat surface 8 enables the awl 2 when placed in the sheath 3 to be worn on a belt 9 of a person using the device without discomfort, since the flat surface 8 is aligned with a belt engaging clip 10 and is turned facing the wearer's hip as shown in FIGS. 1 and 2. The flat surface 8 also provides a portion of the handle 4 which may easily be engaged by the clip 10 to hold the awl 2 in the sheath 3 as will be described later in more detail. The flat surface 8 is also useful in preventing the awl 2 from rolling when placed on a surface such as a table top.

Figure 4:
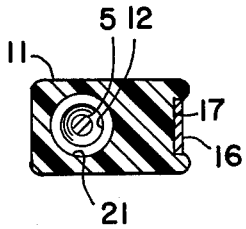
FIG. 4 is a cross-sectional view taken on line 4—4 of FIG. 3.

The sheath 3 is comprised of a clip 10 which is preferably stamped from a flat sheet of steel and formed to the shape best illustrated in FIG. 2 by conventional means which are well known in the metal forming art, and an elongated awl receiving member 11 preferably molded of plastic with an axial bore 12 for receiving the shank 5 of the awl 2. The clip 10 and the awl receiving member 11 are fixedly connected together by a screw 13 or other suitable means passing through a hole 14 in an offset portion 15 formed in a first portion 16 of the clip 10. The awl receiving member 11 is substantially rectangular in cross-section as may be seen in FIG. 4, but has a flat recess 17 extending longitudinally of the member 11 on one of the sides thereof. A counterbore 18 is formed near the longitudinal center of the recess 17 for receiving the offset 15 of the clip 10. It may be seen that the awl receiving member 14 is therefore fixedly attached to the clip 10 by the screw 13 which holds it in the recess 17 so that it cannot rotate about the screw 13.

Figure 3:
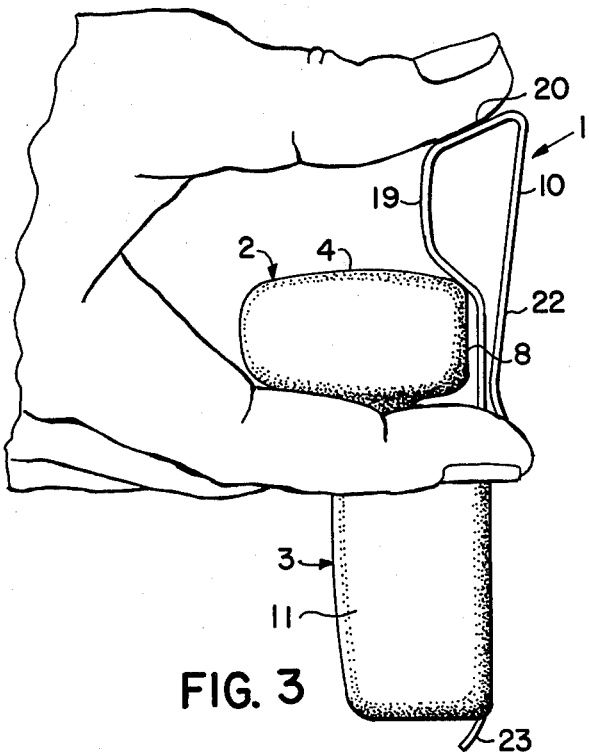
FIG. 3 is a side elevational view similar to FIG. 2 showing the awl being withdrawn from the sheath.

By referring to FIG. 2 it may be seen that the first portion 16 of the clip 10 extends upwardly from the top of the member 11 and has an outwardly bowed portion 19 which extends towards the axial center of the awl 2 when it is in the sheath 3 and engages the top of the handle 4 adjacent the flat surface 8, thereby holding the awl 2 in the sheath 3. The bowed portion 19 merges into a flat portion 20 which is used as shown in FIG. 3 as a pressure surface for the thumb of a user to deflect the clip 10 rearwardly so that the bowed portion will move away from the handle 4 and permit withdrawal of the awl 2 from the sheath 3. By pressing the thumb on the surface of the flat portion 20 and simultaneously pulling upwardly on the handle 4, the awl 2 may be easily removed from the sheath 3. By pressing on the flat portion 20 the awl 2 may be slipped past the bowed portion 19 and returned to the sheath 3 where it is locked in position by the bowed portion 19.

It should be mentioned that the axial bore 12 has an enlarged diameter portion 21 near the top to receive the shank receiving part 7 of the handle 4.

In addition to the first portion 16 of the clip 10, a second portion 22 is folded downwardly from the first portion 16 at the upper end of the flat portion 20 and the second portion 22 extends downwardly alongside of the first portion 16 to form a hook for engaging the belt 9 of a wearer as shown in FIGS. 1 and 2. A lower extension 23 of the clip 10 projects below the member 11 to help guide the sheath 3 when it is being placed on the belt of a wearer and protect the wearer's clothes from damage.

While the dimensions of the invention may vary somewhat, the shank 5 should be long enough to provide a hole which is deep enough to accomodate any standard size golf tee and smaller in diameter that the diameter of the golf tee at the portion that is below ground when the tee is in operative position. Golf tees may vary in diameter from approximately 0.150" (3.81 mm.) to 0.200" (5.08 mm.), depending upon whether they are wood or plastic. A good working diameter for the shank is from 0.100" (2.54 mm.) to 0.1875" (4.76 mm.). This produces a hole which should hold the tee firmly in the ground. The length of the shank may vary from 1" (25.4 mm.) to 1.75" (44.45 mm.). This range should provide a hole of sufficient depth for any standard size tee.

While for the purpose of illustrating the invention the handle and the awl receiving member are shown as made of plastic and the shank of the awl and the clip of the sheath are shown as made of metal, it should be understood that various other materials could be used so long as they have the necessary physical properties. These and various other modifications can be made herein without departing from the scope of the invention.

I claim:

1. The combination of a golf tee awl for making holes in the ground for inserting golf tees and a sheath comprising:

(A) a handle portion to be held in the hand of the user;

(B) a shank portion having one end thereof attached to the handle portion;

(C) the opposite end of the shank portion having a sharpened point to provide ease of penetration into the ground when pressure is exerted against the handle portion;

(D) the handle portion having at least one flat surface lying in a plane parallel to the longitudinal axis of the handle and shank portion; and (E) a sheath for attachment to the golf tee awl comprising;

(1) an elongated awl receiving member having an axial receptacle therein for receiving the shank portion of the awl, and (2) an elongated clip having a first portion fixedly attached to the exterior of the awl receiving member in parallel alignment with the axis of the receptacle thereof, and a second portion folded over against the first portion, the clip being adapted to receive the belt of a wearer between the first and second portion thereof, (3) an outwardly extending awl retaining means on the first portion of the clip, to releasably engage the flat surface of the handle portion of the awl and retain the awl in the sheath, (4) said awl retaining means having a relatively flat portion inclined at an angle with respect to the axis of the receptacle, against which pressure may be applied by the thumb of the user of the device to move the awl retaining means out of engagement with the handle portion to permit withdrawal of the awl from the sheath by simultaneously pulling upwardly on the handle of the awl.

2. The combination claimed in claim 1 wherein the means attaching the clip to the awl receiving member is at least one screw passing through an opening in the clip and screwed into the awl receiving member.

3. The combination as claimed in claim 1 wherein the awl receiving member has an axially extending recess for receiving and retaining the first portion of the clip.

4. The combination of a golf tee awl for making holes in the ground for inserting golf tees and a sheath comprising:

(A) an awl having;

(1) a handle, and (2) a shank having one end connected to the handle and the opposite end being pointed for insertion into the ground, and (B) a sheath comprising;

(1) an elongated clip for attachment to the belt of a person using the awl, (2) an elongated awl receiving member fixedly attached to the clip in parallel alignment therewith, (3) said awl receiving member having an axial receptacle therein for receiving the shank, and (4) an outwardly extending awl retaining means on the clip engaging the handle of the awl to releasably retain the awl in the sheath, (5) said awl retaining means having a relatively flat portion inclined at an angle with respect to the axis of the receptacle, against which pressure may be applied by the user's thumb to move the awl retaining means out of engagement with the handle portion to permit withdrawal of the awl from the sheath by simultaneously pulling upwardly on the handle.

5. The combination as claimed in claim 4 wherein the means attaching the clip to the awl receiving member is at least one screw passing through an opening in the clip and screwed into the awl receiving member.

6. The combination as claimed in claim 4 wherein the awl receiving member has an axially extending recess for receiving and retaining the first portion of the clip.

* * * * *